United States Patent [19]

Brokenshire

[11] Patent Number: 4,609,132

[45] Date of Patent: Sep. 2, 1986

[54] GRAVITY ACTUATED LOCKING GARMENT HANGER

[76] Inventor: Douglas B. Brokenshire, 20209 87th. Ave. West, Edmonds, Wash. 98020

[21] Appl. No.: 727,597

[22] Filed: Apr. 26, 1985

[51] Int. Cl.[4] ..... A47G 25/48; A41F 1/00

[52] U.S. Cl. ..... 223/96; 24/505; 24/511

[58] Field of Search ..... 223/95, 96, 85, 90, 223/91, 93; 70/59; 24/505, 511, 517, 542

[56] References Cited

U.S. PATENT DOCUMENTS

| | | | |
|---|---|---|---|
| 872,587 | 12/1907 | Spruce | 223/96 |
| 1,018,056 | 2/1912 | Hincher | 223/96 |
| 1,417,009 | 5/1922 | Woodward | 223/91 |
| 1,448,811 | 3/1923 | Morrison | 24/537 |
| 2,624,496 | 1/1953 | Williams | 223/96 |
| 2,717,108 | 9/1955 | Schaefer | 223/91 |
| 2,908,431 | 10/1959 | Campbell | 223/96 |
| 2,970,726 | 2/1961 | Brooke | 223/96 |
| 3,235,928 | 2/1966 | Clark | 24/517 |
| 3,312,379 | 4/1967 | Gunzberg | 223/96 |
| 3,744,686 | 7/1973 | Levitin | 223/96 |
| 4,562,618 | 1/1986 | Masuda | 24/511 |
| 4,566,157 | 1/1986 | Packendorff | 24/542 |

*Primary Examiner*—Louis K. Rimrodt
*Assistant Examiner*—Joseph S. Machuga
*Attorney, Agent, or Firm*—Graybeal & Cullom

[57] ABSTRACT

A lockable, hinged garment hanger wherein the locking mechanism is gravity actuated and substantially enclosed between spring biased hanger arms, the locking mechanism including a lock actuator arranged between first and second wedging surfaces, each carried by an associated hanger arm and facing the other hanger arm, the configuration of the wedging surfaces and the lock actuator being such that, with the hanger upright and the hanger arms closed, the wedging surfaces retain the lock actuator in a lower position to hold the hanger arms closed, the hanger arms being unlocked and opened under spring action by inverting the hanger and manually squeezing the hanger arms together slightly, enabling the lock actuator to move by gravity from its wedged locking position toward the hinged ends of the hanger arms and release the arms to open. The lock actuator is preferably cylindrical in nature, working against restraining surfaces in intersecting planar arrangement, with the major axis of the lock actuator being generally parallel to the axis of the hinge means joining the hanger arms. The hanger can be either of the hook suspended type, or in the nature of a clothespin.

11 Claims, 3 Drawing Figures

GRAVITY ACTUATED LOCKING GARMENT HANGER

FIELD OF THE INVENTION

This invention relates to garment hangers, and more particularly to garment hangers which are locked in a closed position by a concealed, gravity actuated locking mechanism which engages opposed wedge surfaces arranged between the hanger arms.

DESCRIPTION OF THE PRIOR ART

Locking adjustable garment hangers are devices for clamping and locking upon a garment which is to be suspended from the hanger. Such devices characteristically include two opposed hanger arms, a hinge rotatably connecting the hanger arms, a hook for suspending the hanger, and a locking mechanism for locking the hanger arms in a closed position. In the closed position, a portion of the garment is frictionally gripped by the hanger arms, said arms being separated by a relatively small distance determined by the thickness of the garment. Several mechanisms for locking the hanger arms in the closed position are known. U.S. Pat. Nos. 1,018,056 to Hincher and 2,970,726 to Brooke, both disclose locking means extending around the exterior surfaces of the hanger arms. The locking mechanisms of these devices are clearly visible, thus diminishing the esthetic appearance of the hanger. In addition, the necessary external movement of the locking mechanism around the hanger arms may prevent the user from securely gripping the hanger.

U.S. Pat. No. 3,744,686 to Levitin discloses a double headed locking slide pin extending between the hanger arms and movable vertically within a vertical slot in each arm. The heads of the slide pin which protrude from the exterior surface of the hanger arm prevent the user from grasping the hanger near the hinge means without interfering with the movement of the pin, and require the user to grasp the hanger near the free ends of the hanger arms. However, the distance separating the gripping portions of the hanger arms when the hanger is in the open position may be greater than the user's hand is capable of spanning, thus forcing the user to manipulate the hanger using both hands. This leaves neither of the user's hands free to support the garment. Furthermore, the wide span may prove insurmountable to persons suffering from an arthritic condition.

SUMMARY OF THE INVENTION

It is an object of this invention to provide a garment hanger having a gravity actuated locking mechanism.

It is another object of this invention to provide a locking garment hanger which is easily manipulated using only one hand.

It is a further object of this invention to provide a locking garment hanger wherein the locking mechanism is completely enclosed between the hanger arms so as not to interfere with the user's grasp of the hanger.

It is a further object of this invention to provide a locking clothes hanger with hanger arms interconnected by hinge means at the upper ends of the arms and by spring means biasing the lower ends of the arms to an open position, with gravity actuatable lock means arranged between the hanger arms and comprising interfacing wedge surfaces on the respective hanger arms and a lock actuator situated between said wedge surfaces and arranged to have a limited degree of guided free fall with respect to said wedge surfaces, said wedge surfaces being arranged to occupy planes having a small acute angle therebetween when the hanger arms are in closed position, the hanger arms being locked in such closed position by the lock actuator falling and becoming wedged between said wedge surfaces with the hanger in an upright position, the hanger arms being unlocked to open the arms when the hanger is inverted by the user who by slight pressure on the hanger arms relieves the wedged condition of the lock actuator, permitting it to fall away from the wedge surfaces whereupon the spring means moves the lower ends of the hanger arms to their open position.

It is another object of the present invention to provide a lockable clothes hanger which may be of the suspension type with hook means by which the hanger is suspended from a support bar such as in a closet, or which may simply be of a type including two hinged, spring biased hanger arms whereby the hanger may be applied to grasp a supporting element such as a clothesline, i.e. the hanger is configured in the nature of a clothespin.

These and other objects of the present invention which shall be subsequently disclosed herein are provided by a gravity actuated locking adjustable garment hanger comprising two opposed hanger arms, a hinge connecting the two hanger arms, a spring tending to open the hanger arms, and an internally enclosed gravity actuated locking and unlocking mechanism.

The locking mechanism includes a gravity actuated lock actuator and first and second hanger arm restraints in the form of wedge surfaces. The lock actuator is positioned between the hanger arms, and is movable by gravity toward the free ends of the hanger arms when the hanger is suspended by the hook. When the hanger is inverted, the lock actuator is moved by gravity toward the hinged ends of the hanger arms. The first and second hanger arm restraints operate to positively restrain the hanger arms when actuated by the lock actuator. The first and second hanger arm restraints face each other and are attached to respective hanger arms. An operable length of each hanger arm restraint is spaced a predetermined minimum distance from the hanger arm to which it is attached. Each restraint confines all or a portion of the lock actuator between it and the associated hanger arm. It is this confinement of the lock actuator between the first and second hanger arm restraints and their associated hanger arms which operates to positively restrain and lock the hanger arms in the closed position when the hanger is upright with the hanger arms in the closed position and the lock actuator is moved by gravity to its lowermost position between the restraints.

Other features and advantages of the present invention will become apparent from the following detailed description, taken in conjunction with the accompanying drawings.

DESCRIPTION OF THE PREFERRED EMBODIMENT

Figure 1:
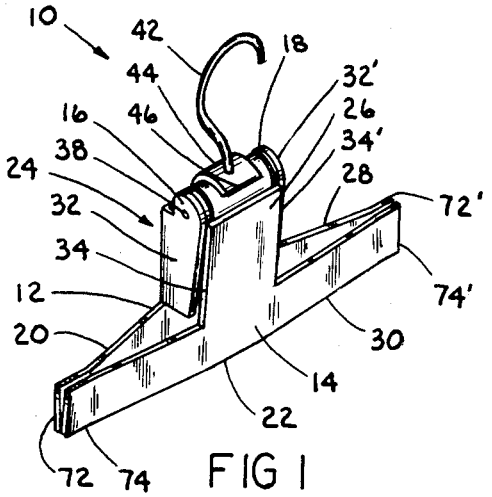
FIG. 1 is a three-dimensional isometric view of the gravity actuated locking hook suspended type garment hanger embodying the present invention and shown in the closed position.
Figure 2:
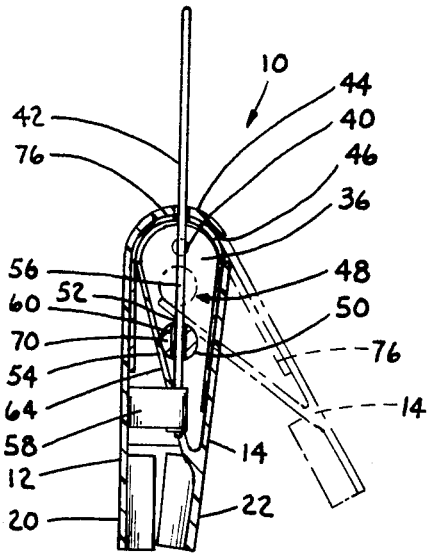
FIG. 2 is a cross-sectional view taken centrally through the garment hanger of FIG. 1, showing the interaction between the lock actuator and the hanger arm restraining means between the closed position (shown by solid line) and the open position (shown by dashed lines).

As best seen in FIGS. 1 and 2, the gravity actuated locking garment hanger 10 of this invention comprises two opposed hanger arms 12, 14. Each of the hanger arms 12, 14 has a respective hinged end portion 16, 18, whereby each hanger arm is attached to the opposite hanger arm, and an opposite free end 20, 22. A lever or panel 24, 26 of each respective hanger arm 12, 14 extends in a vertical direction between the respective hinged ends 16, 18 and the free ends 20, 22 of the hanger arms 12, 14, and comprises a rigid, flat, substantially rectangular surface facing the opposing hanger arm. Gripping bars 28, 30 are respectively rigidly attached to the levers 24, 26 at the free ends 20, 22. Side walls 32, 32' of arm 12 and 34, 34' of arm 14 depend perpendicularly from opposing vertical edges of the levers 24, 26 respectively, and operate to stiffen the levers against bending.

The distance between the side walls 32, 32' of the first hanger arm 12 is slightly greater than the distance between the side walls 34, 34' of the opposing second hanger arm 14', allowing the side walls of the first hanger arm to be positioned within the side walls of the opposing second hanger arm 12. This "nesting" of the side walls prevents them from interfering with the smooth operation of the hanger between the open and closed positions. A hinge means for rotatably connecting the hanger arms 12, 14 is comprised of the hinged ends 16, 18 of the hanger arms and two hinge pins 38, 40 respectively interconnecting said hinged ends. The nested side walls 32, 32', 34, 34', and the levers 24, 26 together define a shielded internal interspace 36.

To allow suspension of the locking garment hanger from a closet or like support bar or the like in the manner of a conventional garment hanger, a hook 42 and hook support 44 are provided. The hook 42 extends substantially perpendicularly from the exterior surface of the hook support 44, and has the shape of a conventional hanger support hook. The hook support 44 extends from the uppermost edge of the lever 24 of the first hanger arm 12, and is preferably formed in the shape of a section of a cylindrical wall having an axis coaxial with the axis of the hinge pins 30, 40. A free edge 46 of the hook support 44 is located opposite a fixed edge attached to the horizontal edge of the lever 24. The free edge 46 serves as a stop means preventing excessive opening of the hanger arms 12, 14 when the hanger is in the open position, engaging the uppermost edge of the lever 26 of the opposed second hanger arm 14 when the hanger is in the open position. To satisfactorily perform this function, the hook support 44 is constructed to have sufficient strength to positively resist excessive opening of the second hanger arm 14. It has been determined that fabrication of the hook support 44 from the same flat material comprising the lever 24 produces a hook support of sufficient strength.

A locking mechanism 48 of the hanger 10, best shown in FIG. 2, comprises a lock actuator 50 and first and second wedge surfaces or restraints 52, 54.

The locking mechanism 48 operates to positively lock the hanger arms 12, 14, in the closed position through the gravity actuated movement of the lock actuator 50 and its wedging interaction with the restraints 52, 54. As shown, an operable length of each restraint 52, 54 limits the horizontal movement of the lock actuator 50, confining all or a portion of the lock actuator between the restraint and the hanger arm to which the restraint is fixedly attached. The lock actuator is otherwise free to move vertically within the interspace 36.

When the lock actuator 50 is in its uppermost position closest to the hinged ends 16, 18, the hanger arms may open relatively widely, placing the hanger 10 in the open position. As the lock actuator 50 is moved by gravity downwardly toward the free ends 20, 22, its engagement with the wedge surfaces 52, 54 forces the free ends of the hanger arms progressively closer to each other. When the lock actuator 50 is positioned in its lowermost position closest to the free ends of the hanger arms, and the hanger arms are in the closed position, the lock actuator's wedged engagement against the restraints prevents separation of the hanger arms, thus positively locking them in the closed position. When the hanger 10 is inverted and the levers 24, 26 urged together slightly, the wedging action is relieved and the lock actuator may then move by gravity toward the hinged ends, unlocking the hanger arms.

The lock actuator 50 preferably comprises a cylindrical element positioned in the interspace 36 between the hanger arms 12, 14, oriented with its major axis parallel to the axis of the hinge pins 35, 40, i.e. horizontal and parallel to the levers 24, 26 and gripping bars 28, 30. The lock actuator 50 must possess sufficient weight to positively move by gravity when free to do so. It has been determined that the lock actuator 50 may be suitably constructed as a solid metal cylinder approximately $\frac{1}{4}''$ to $\frac{3}{8}''$ in diameter and $1\frac{1}{2}''$ to $2''$ in length, using brass, steel, or other metal of substantially equivalent unit weight.

Although several configurations of the first and second restraints 52, 54 are capable of performing as required, the particular design of the first and second restraints shown in FIG. 2 combines features of smooth and reliable operation with simplicity of fabrication and assembly. The first hanger arm restraint 32 is fixedly attached to the first hanger arm 12, and comprises a relatively slender guide rod 56 and a guide rod anchor 58. The guide rod 56 is suitably an extension of a shank portion of the hook 42, and extends from the hook support 44 downwardly through the interior space 36 toward the free end 20. The guide rod 56 is substantially parallel to the lever 24, and is spaced therefrom a predetermined distance. The guide rod anchor 58 is fixedly attached to the interior surface near the free end 20 and securely anchors the end of guide rod 56. As shown an operable length of the guide rod 56 of the first hanger arm restraint 52 is defined between the guide rod anchor 58 and the hook support 44. The guide rod 56 and its anchor 58 are positioned in the center of the hanger 10, substantially midway between the side walls 32, 32', 34, 34', and substantially midway between the levers 24, 26 when the hanger is in the closed position.

The guide rod 56 extends through a hole 60 in the lock actuator 50, allowing the lock actuator to move freely in the vertical direction parallel to the guide rod, while preventing horizontal translation thereof. Thus, the portion of the lock actuator 50 between the hole 60 and the surface of the actuator facing the first hanger arm 12 is confined between the guide rod 56 and said arm.

The second hanger arm wedge surface restraint 54 operates to confine the entire volume of the lock actuator 50 between the second restraint and the second hanger arm 14, and comprises two flat rectangular elongated restraints 62, 64 extending through the interior space 36, rigidly attached to the second hanger arm 14 near the free end 22 of said arm and forming a relatively small acute angle with said arm. Each of the flat restraints 62, 64 extends from said point of attachment to a respective distal end 66, 68.

Figure 3:
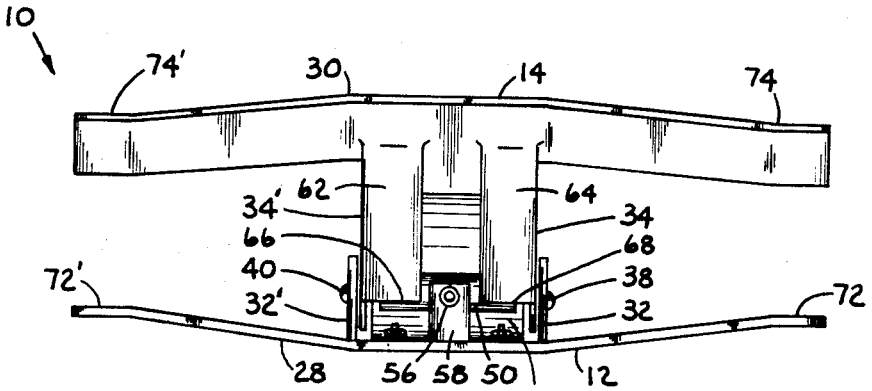
FIG. 3 is a bottom plan view of the garment hanger of FIG. 1, looking upward from the free ends of the hanger arms, and showing in particular the first and second hanger arm restraints.

Each flat restraint 62, 64 is respectively attached along an outer side edge to a side wall 34, 34' of the second hanger arm 14, providing a sturdy support along the length of each flat restraint. As shown in FIG. 3, the flat restraints 62, 64 are separated laterally by a gap sufficient to allow the guide rod 56 and anchor 58 to be positioned between the flat restraints. An operable length of each flat restraint 62, 64 is defined between the respective distal end 66, 68 and the point of attachment of said flat restraint.

When the hanger arms are in the closed position, as shown by the unbroken lines of FIG. 2, the distal ends 66, 68 of the flat restraint 62,64 are positioned adjacent the first hanger arm 12, causing the flat restraints to extend diagonally through the interior space 36. When the hanger arms are in the open position as shown by the broken lines in FIG. 2, each distal end 66, 68 is separated from the first hanger arm 12 by a relatively small distance, thus remaining within the volume defined between the first restraint 52 and the first hanger arm. The distal ends 66, 68 of the flat restraints 62, 64 are at all times positioned between the exterior of the lock actuator 50 and the first hanger arm 12, preventing the lock actuator from becoming jammed. This design insures that the lock actuator 50 is at all times confined between the flat restraint 62, 64, and the second hanger arm 14. It is the simultaneous confinement of this mutually confined portion 70 of the lock actuator 50 between the guide rod 56 of the first restraint 52 and the first hanger arm 12, and between the flat restraints 62, 64 and the second hanger arm 14, which produces the gravity responsive locking and unlocking action which is the essential feature of this invention.

When the hanger arms are in the closed position, the lower end of the guide rod 56 near the anchor 58 is positioned within the gap between the flat restraints 62, 64 and the entire guide rod is wedged in the region defined between the flat restraints and the second hanger arm 14. In this closed position, when the hanger 10 is suspended upright by the hook 42, the lock actuator 50 is moved by gravity to its lowermost position, where its mutually confined portion 70 is wedged between the guide rod 56 and the flat restraints 62, 64. This wedging action prevents the second hanger arm 14, attached to the flat restraints 62, 64, from moving away from the first hanger arm 12 toward the open position. In this fashion the hanger 10 is securely locked into the closed position. Subsequent inversion of the hanger 10, without more, will not unlock the hanger.

The hanger is unlocked by simply manually squeezing the levers 24, 26 toward each other while the hanger is in the inverted position, unwedging the mutually confined portion 70 of the lock actuator 50 and allowing the lock actuator to drop along the guide rod 56 toward its alternate position near the hinged ends 16, 18 of the hanger arms. To ensure the unwedging of the lock actuator 50 when the levers 24, 26 of the hanger arms are squeezed together, opposite terminal ends 72, 72', 74, 74' of the gripping bars of each hanger arm are offset inwardly toward the terminal ends of the gripping bar of the opposite hanger arm, as best seen in FIG. 3. This offset allows the levers 24, 26 of each arm to move inwardly toward each other when they are squeezed.

As shown in FIG. 2, a flat leaf spring 76 is provided to bias the hanger arms 12, 14. The spring 76 is suitably a flat piece of resilient spring material such as spring steel rigidly attached to the interior surface of the first hanger arm 12, and extends upwardly from said attachment toward the hinged end 16 of the first hanger arm where it is curved beneath the curved surface of the hook support 44 and directed toward the second hanger arm 14. From the hinged ends the spring extends downwardly along the interior surface of the lever 26 of the second hanger arm 14, terminating at a point between the hinged end of the second hanger arm and the fixed ends where the flat restraints 62, 64 are attached to the interior surface of the second hanger arm.

When released the lock actuator 50 is free to move to an uppermost position adjacent the interior surface of the spring 76. This location of uppermost position ensures that the maximal open position of the hanger arms 12, 14 is determined by the engagement of the free edge 46 of the hook support 44 with the uppermost edge of the lever 26 of the second hanger arm 14 as described above. If the uppermost position of the lock actuator 50 were at or below the axes of the hinge pins 38, 40, the maximal open position would be determined by the interaction between the lock actuator 50 and the first and second restraints 52, 54. It has been determined that the positive limit provided by the hook support 44 against the lever 26 of the second hanger arm 14 is the superior means of limiting the opening of the hanger arms.

As will be readily understood, although the typical embodiment of the invention illustrated and described in detail above is a clothes hanger of the type including a suspension hook, the external suspension hook is not of itself an operative element insofar as the gravity actuated locking and unlocking of the spring biased hanger arms. Thus, one variation in construction of the hanger embodying the present invention can be in the nature of a clothespin which may be inverted to unlock and open and held upright to close and lock and which holds a garment or the like in a supported position on a clothesline or the like which is grasped between the arms in their closed position along with a garment or the like.

It will also be understood that, although specific embodiments of the invention have been described herein for purposes of illustration, various modifications may be made without departing from the spirit and scope of the invention. Accordingly, the invention is not limited except as by the appended claims.

What is claimed is:

1. An improved, gravity-actuated, locking garment hanger, comprising:

two opposed hanger arms each having a hinged end whereby each said arm is attached to the other arm, and each having an opposite free end;

hinge means rotatably connecting the hinged ends of the hanger arms to allow movement of the arms between a closed position wherein the free ends of the hanger arms are separated by a relative small distance and an open position wherein the free ends of the hanger arms are separated by a relatively large distance;

spring means arranged between and biasing the hanger arms toward the open position; and a gravity actuated mechanism for locking the hanger arms in the closed position, including:

a gravity operated lock actuator which is positioned between the hanger arms, and which is movable by gravity toward the free ends of the hanger arms when the hanger is upright and toward the hinged ends of the arms when the hanger is inverted; and first and second wedging surfaces arranged between the hanger arms, for restraining the hanger arms when actuated by the lock actuator, each said wedging surfaces being attached to an associated hanger arm and including an operable length spaced a predetermined minimum distance from the hanger arm to which it is attached, each such said wedging surfaces confining a mutually wedged portion of the lock actuator between it and its associated hanger arm, such confinement positively restraining and locking said hanger arms in the closed position when the hanger is upright with the hanger arms in the closed position and the lock actuator has moved by gravity to its lowermost position between said wedging surfaces.

2. The garment hanger of claim 1, wherein the first hanger arm wedging surface comprises a guide rod extending between the hinged end of an associated hanger said arm and guide rod anchor means fixedly attached near the free end of said arm.

3. The garment hanger of claim 2, wherein the hanger further comprises suspension means in the form of conventional hook attached to the hanger arm associated with the guide rod, and where the guide rod and the hook are fabricated as a single element.

4. The garment hanger of claim 2, wherein the second hanger arm wedge surface comprises two elongated flat restraints separated laterally from each other by a predetermined minimum distance, and fixedly attached to the associated second hanger arm near the free end of said arm and extending therefrom toward the hinged end of the opposite hanger arm.

5. The garment hanger of claim 1, wherein the hinge means comprises at least one hinge pin, and where the major axis of the lock actuator is substantially coaxial with the axis of the hinge pins when the hanger arms are in their open position.

6. The garment hanger of claim 1, further including respective lever portions of the hanger arms, wherein the hanger arms are unlocked and allowed to move from the closed position to the open position by inverting the hanger and manually squeezing said lever portions toward each other, causing the lock actuator to move by gravity toward its uppermost position near the hinged ends of the hanger arms.

7. The garment hanger of claim 1, further including two gripping bars, each fixedly attached to the free end of a hanger arm and extending perpendicularly therefrom substantially parallel to the axis of rotation of the hinge means, wherein respective terminal ends of each gripping bar are offset toward the terminal ends of the opposite gripping bar to allow slight movement of the center portions of the gripping bars toward each other when the hanger is unlocked.

8. The garment hanger of claim 1, further including side walls integral with and extending from opposite side edges of the lever portion of each hanger arm toward the opposite hanger arm, said side walls and lever portions substantially enclosing an interspace containing the locking mechanism.

9. The garment hanger of claim 1, further comprising a conventional hook supported by a hook support fixedly attached to a first hanger arms, and where the open position of the hanger arms is determined by the engagement of said hook support with a second opposing hanger arm.

10. A lockable, hinged garment hanger with a gravity actuated locking mechanism which is substantially enclosed between hanger arms joined by hinge means and biased outwardly by spring means, the said locking mechanism including a lock actuator arranged between first and second restraining means, each carried by an associated hanger arm and facing the other hanger arm, the configuration of the restraining means and the lock actuator being such that, with the hanger upright and the hanger arms closed, the restraining means retain the lock actuator in a lower position to hold the hanger arms closed, the hanger arms being unlocked and opened by the user inverting the hanger and manually squeezing the hanger arms together slightly, enabling the lock actuator to move by gravity from its locking position toward the hinged ends of the hanger arms and release the arms to open by action of said spring means, the lock actuator being generally cylindrical with said restraining means being in intersecting planar arrangement with each other, with the lock actuator moving therebetween, the major axis of the lock actuator being generally parallel to the axis of the hinge means joining the hanger arms.

11. A clothes hanger comprising, hanger arms interconnected by hinge means at the upper ends thereof and by spring means biasing the lower ends of the arms to an open position, gravity actuatable lock means arranged between and substantially enclosed by the hanger arms and comprising interfacing wedge surfaces on the respective hanger arms below the hinge means thereof, and a lock actuator situated between said wedge surfaces, and arranged to have a limited degree of guided free fall with respect to said wedge surfaces and the exterior surfaces of the hanger, said wedge surfaces being arranged to occupy planes having a small acute angle therebetween when the hanger arms are in closed position, the hanger arms being locked in such closed position by the lock actuator falling and becoming wedged between said wedge surfaces with the hanger in an upright position and becoming unwedged when the hanger is in an inverted position and the lower ends of the arms are pressed together slightly.

* * * * *